United States Patent [19]

Vaughan

[11] Patent Number: 4,652,351

[45] Date of Patent: Mar. 24, 1987

[54] ELECTROCHEMICAL RESTORATION OF CYANIDE SOLUTIONS

[76] Inventor: Daniel J. Vaughan, 36 Paxon Dr., Wilmington, Del. 19803

[21] Appl. No.: 810,789

[22] Filed: Dec. 19, 1985

[51] Int. Cl.[4] ..... C25C 1/00; C25C 1/12

[52] U.S. Cl. ..... 204/105 R; 204/106; 204/112; 204/114; 204/120; 204/130; 252/79.4

[58] Field of Search ..... 204/130, 106, 112, 114, 204/120, 105 R; 252/79.4

[56] References Cited

U.S. PATENT DOCUMENTS

| | | | |
|---|---|---|---|
| 1,954,664 | 4/1934 | Cain | 204/130 X |
| 3,463,710 | 8/1969 | Lower | 204/106 |
| 4,051,001 | 9/1977 | Inoue et al. | 204/130 X |
| 4,378,270 | 3/1983 | Brasch | 204/106 X |
| 4,468,305 | 8/1984 | Hillis | 204/130 |
| 4,490,224 | 12/1984 | Warheit | 204/130 |
| 4,545,877 | 10/1985 | Hillis | 204/130 |

FOREIGN PATENT DOCUMENTS

| | | | |
|---|---|---|---|
| 908956 | 2/1982 | U.S.S.R. | 204/106 |

OTHER PUBLICATIONS

Girish D. Parikh et al., Western Electric Eng., vol. 16, No. 2, pp. 3–8, Apr. 1972.

*Primary Examiner*—G. L. Kaplan
*Attorney, Agent, or Firm*—Charles J. Tonkin

[57] ABSTRACT

Metal stripping solutions of alkaline cyanide and organic acid stripping agents used to strip metal coatings from steel or other substrates are restored for reuse. The process is a membrane electrochemical process wherein an electric current is passed through an electrochemical cell having a membrane separating the metal strip solution from oxygen formed at the cell anode while the strip solution is restored by removal of stripped metals on the cell cathode as electroplatings. The process restores spent strip solution without producing a toxic waste and reduces potential hazards of handling and shipping. The stripped metals are recovered as metals for use in electroplating and other processes.

8 Claims, No Drawings

ELECTROCHEMICAL RESTORATION OF CYANIDE SOLUTIONS

FIELD OF THE INVENTION

This invention relates broadly to an electroplating process for plating metals from alkaline cyanide solutions and more particularly to a membrane electrochemical process for restoration of a used metal strip solution comprising alkaline cyanide and an organic acid stripping agent, such as (meta nitro-benzenesulfonic acid) benzenesulfonic acid-3 nitro that is used to strip cadmium, zinc, copper, tin, nickel and other metals from steel or other substrates. The instant restoration process comprises an electrochemical cell having a membrane that separates the used metal strip solution from oxygen formed at the cell anode thus preventing degradation of the metal strip solution while reforming the strip solution by removal of the stripped metals from the solution as electroplatings on the cell cathode. The metal strip solution in restored to a new-like condition for use again and again and the stripped metals are recovered for use in electroplating processes or other uses thereby eliminating a hazardous and costly treatment of a toxic waste for disposal.

BACKGROUND OF THE INVENTION

A metal stripping process depends on the difference in chemical activity of the metal to be stripped and the substrate for the metal. For successful stripping the metal to be stripped must be active and the substrate relatively inert to the stripping solution. A solution can always be found that will dissolve a coating on a substrate but only a very few solutions will dissolve a metal coating without affecting the substrate. Alkaline cyanide solutions are used to electrostrip (anodically dissolve) metals and acids are generally used for immersion stripping of metals from a substrate. Both of these methods are difficult to carry out without affecting the substrate, especially if the substrate is steel.

A metal strip solution comprising an alkaline cyanide and an organic acid stripping agent, such as, benzenesulfonic acid-3 nitro, has been used successfully for immersion stripping cadmium, zinc, tin, copper, nickel, silver and other metals from steel substrates without affecting the steel substrate. Stripping of metals occurs rapidly without an anodic potential at low temperatures; however, the strip solution becomes saturated with dissolved metals and the spent solution must now be treated as a toxic waste.

Heretofore, there has been no method for restoring the used alkali cyanide-organic acid metal strip solution so that it can be used again and thereby eliminate the hazardous and costly treatment of the spent strip solution for disposal as a waste.

Attempts to restore the spent strip solution using electrodialysis, ion exchange and other non-destructive chemical methods have been unsuccessful because the metals are chelates or complex compounds. Metals are electroplated from alkaline cyanide solutions in conventional electrolysis cells having a soluble metal anode that does not form oxygen in the plating liquor and a cathode for electrodepositing metals. In this conventional process, metals are stripped (anodically dissolved) at the anode at essentially the same rate as metals are deposited at the cathode and this conventional process with a soluble metal anode is not suitable for removing metals from a spent metal strip solution of alkaline cyanide, organic metal stripping agent and dissolved metals. Attempts to use insoluble anodes to electroplate metals from the spent strip solution resulted in decomposition of the strip solution.

Disposal of the spent strip solution has required chemical destruction and removal of metals from the solution. Chemical destruction is generally carried out using excess calcium or sodium hypochlorite and several hours are required to decompose the solution for metal salt removal. Most on-site waste treatment facilities are inadequate for treating the spent strip solution and the solution must be shipped to an off-site waste treatment facility.

It would be desirable to restore the spent strip solution without producing a toxic waste and restore the solution on-site of use to reduce potential hazards of handling and shipping. Preferably, the strip solution would be restored continuously as used without producing a toxic waste so that the quantity of strip solution would be a minimum. It is an object of the instant invention to provide a process capable of continuous restoration of metal strip solutions comprising alkaline cyanide and an organic metal stripping agent without producing a toxic waste whereby the strip solution can be used again and again for stripping metals and the stripped metals are recovered as metals for use in electroplating and other processes.

SUMMARY OF THE INVENTION

A process is provided which can continuously restore a spent metal strip solution comprising an alkaline cyanide and an organic acid metal stripping agent, such as benzenesulfonic acid-3 nitro without producing a toxic waste whereby the metal strip solution can be used again and again for stripping metals. The instant process is a membrane electrochemical process wherein an electric current is passed through an electrochemical cell having a membrane separating the metal strip solution from oxygen formed at the cell anode while the strip solution is restored in a reducing environment by removal of the stripped metals on the cell cathode as electroplatings. The aqueous stripping solution contains an alkali metal cyanide, an organic acid metal stripping agent and a dissolved metal. The electroplated metals are suitable for use in electroplating processes and other uses.

DETAILED DESCRIPTION OF THE INVENTION

An electrochemical process is provided for restoring a metal strip solution comprising an alkaline cyanide and an organic metal stripping agent, such as benzenesulfonic acid-3 nitro and a dissolved metal. The process comprises passing an electrical current through an electrochemical cell having a catholyte compartment containing a cathode and a metal strip solution with a dissolved metal, an anolyte compartment containing an anode and an aqueous anolyte and an electrically conductive membrane separating the cell compartments whereby the metal strip solution is restored to a new-like condition by not contacting the strip solution with the anode or oxygen evolved at the anode while electroplating and removing the dissolved metal on the cathode in a reducing hydrogen environment.

The catholyte, metal strip solution of the instant process can be any solution used to strip metals containing an alkaline cyanide such as sodium or potassium cyanide, an organic metal stripping agent and a dissolved metal. The metal strip solution can comprise other metal chelating and complex compound forming agents, wetting agents, inorganic salts and materials associated with the metal stripping operation.

The organic metal stripping agent can be any such agent capable of causing dissociation of the surface metal from the metal substrates such as steel. Such agents are preferably organic compounds having sulfonic or carboxylic acid groups or salts thereof, usually as ring substituents on aryl compounds and preferably having other ring substituents such as nitro groups in the meta position with respect to the acid substituent. More generally, the organic acid metal stripping agent is an organic compound comprising sulfonic, sulfenic, carboxylic or phosphinic acid groups. Suitable agents include benzenesulfonic acid-3 nitro, benzenesulfenic acid-3 nitro and benzenecarboxylic acid-3 nitro and their salts such as sodium or other alkali metal and ammonium salts. Other organic metal stripping agents such as tartaric acid, citric acid, and meta nitrobenzoic acid will be apparent to those skilled in the art. Substrates are generally steel but can be plastic, glass, ceramic or other metal sufficiently inert to the stripping solution. It has been postulated that these metal stripping solutions of alkali metal cyanides and organic metal stripping agents act with such agents dissolving the metal coating and the cyanide forming chelates or other complexes to maintain the stripped metal in solution. Metal stripping is described more fully at pp. 401–411 of "Metal Finishing Guidebook Directory 1985", Metals and Plastics Publications, Inc.; One University Plaza, Hackensack, NY 07601, which is incorporated by reference.

The stripping action results in solutions containing metals as metal complexes such as cadmium, zinc, nickel, copper, tin and like metals used in electroplating as well as mixtures thereof.

Where the stripping solution is continuously treated the concentrations of the metals to be removed will be lower than in the case of batch treatment. Normally the concentrations of alkali cyanide and organic metal stripping agent will vary depending upon the metal being stripped but usually will be in the following ranges, as is known, such as, for example, sodium cyanide 6 to 10%, sodium hydroxide 0 to 3%, organic stripping agent (meta-nitrobenzene sulfonic acid sodium salt) 3 to 8%.

The cathode of the electrochemical cell of the instant process is any cathodic surface suitable for electroplating and removing a metal from the metal strip solution. The cathode can be porous, fibrous, particulate or solid or composite structures. The cathode can be of the metal being electroplated from the metal strip solution or other metals or non-metals, such as carbon, graphite and reduced titanium dioxide. Preferably the cathode material is suitable for electroplating and removing metals from the metal strip solution and for electrodissolving the electroplated metals in alkaline cyanide and acidic metal plating liquors. Steel cathodes are suitable for electroplating metals from the metal strip solution and anodic dissolution of the plated metal into alkaline cyanide plating liquors. Carbon graphite and reduced titanium dioxide are suitable cathodes for electroplating metals from the metal strip solution and for anodic dissolution of the plated metal into acidic plating liquors. Preferably, the cathode is suitable for electroplating and retaining the electroplated metal in cathodic contact while the cathode is immersed in the strip solution. The cathode can be enclosed in a plastic screen, netting or fabric to facilitate retention of the electrodeposited metal in cathodic contact.

As indicated, the cathode becomes loaded with the recovered metal and hence can be replaced from time to time. The removed cathode can then be placed in an electroplating liquor and connected anodically to effect dissolution of the electroplated metal. After dissolution of the electroplated metal, the electrode can be reused in the catholyte.

Any membrane suitable for passage of electrical current through the electrochemical cell and preventing the anode and oxygen formed at the anode from contacting the metal strip solution can be used in the instant process. The membranes are preferably membranes of hydrocarbon and halocarbon polymers having fixed negative or positive charges distributed in the polymer matrix and are permeable to cations or anions. Preferably the membranes are cation permeable membranes having fixed negative charges distributed in the polymer matrix and are permeable to positively charged ions. Particularly suitable cation permeable membranes are membranes of perhalocarbon polymers containing pendant sulfonic acid, sulfonamide or carboxylic acid groups such as described in U.S. Pat. No. 3,282,875. The membranes may be a multi-layered structure of different polymers and contain fillers, reinforcements and chemical modifiers. The preferred membranes are substantially chemically stable to the process conditions and mechanically suitable for design and economical opertion of the electrochemical process. The most preferred membranes are the perfluorocarbon membranes, such as Nafion ™, manufactured by Dupont, that contain sulfonic, carboxylic or sulfonamide groups.

Any material that is anodic and substantially insoluble when connected anodically in the anolyte can be used as the anode in the instant process. Preferably the anodes are dimensionally stable and have large surface areas and long service life. Particularly suitable anodes are anodes of a titanium substrate having an electrocatalytic coating of platinum group metals or metal oxides, anodes of reduced titanium dioxide ($TiO_x$) where x is a number in the region 1.67 to 1.9, and anodes of carbon or reticulated glassy carbon, graphite and lead.

The anolyte of the instant process can be any aqueous electrolyte. Preferably the anolyte is a very dilute solution of sulfuric acid with or without sodium sulfate. The anolyte can be alkaline or alkaline solutions with salts or aqueous solutions of salts. Preferably the anolyte comprises hydrogen ions and alkali metal cations that are easily electrotransported through cation permeable membranes into the alkaline metal strip solution catholyte. For safety in handling and using alkaline cyanide solutions it is essential that the solution not be acidified without provisions for safely handling hydrogen cyanide gas. When an acidic anolyte is used in the instant process, the quantity of anolyte and concentration of acid in the anolyte should not be sufficient to acidify the metal strip solution to form hydrogen cyanide. Methods for safe handling and use of solutions containing cyanide are readily available in literature and these methods should be employed at all times when working with alkaline cyanide metal strip solutions.

The electrochemical cell of this invention will have at least two compartments but may have three or more compartments. The third and additional compartments would separate the metal strip solution from the anolyte and provide increased safety of operation when an acidic anolyte is used. The compartments can be separated by cation, anion, or neutral ion permeable membranes or combinations of membranes. The electrolytes in the third and other additional compartments can be neutral, acidic or alkaline. Preferably in a three compartment cell, the compartments are separated by cation permeable membranes and the electrolyte in the third compartment is an alkaline or neutral solution of salts.

To illustrate the practice of the process of the instant invention, an electrochemical cell was assembled having an anolyte compartment containing an anode and an anolyte, a catholyte compartment containing a cathode and a catholyte, a metal strip solution comprising an alkaline cyanide, an organic acid metal stripping agent, such as benzenesulfonic acid-3 nitro and a dissolved metal. The cell compartments were separated by a perfluorocarbon polymer sulfonic acid membrane. The cell had a membrane electrolysis area of nine square inches and equipped for adding water to the anolyte compartment and removal of the cathode. The top of each compartment was open to facilitate changing anolyte and catholyte solutions and anodes and cathodes. The volume of the anolyte compartment was 100 ml and the volume of the catholyte compartment was 5000 ml. The cell was equipped with a rectifier with an output rating of 0–12 volts and 0 to 150 ampere, made by Rapid Electric Co. The anode and cathode were installed in the respective compartments and connected to the rectifier. The anolyte was added to the anolyte compartment and a metal strip solution with a dissolved metal was added to the catholyte compartment. Electric current was passed through the cell whereby oxygen was evolved from the anolyte and metals were electroplated on the cathode.

The metal strip solutions were prepared by dissolving sodium cyanide and benzene sulfonic acid-3 nitrosodium salt in water to form a solution of 9.5% by weight sodium cyanide and 6.5% by weight benzenesulfonic acid-3 nitro. A metal was added to the strip solution to effect saturation of the solution with metal. The metal saturated solution was then restored as hereinafter described. Metal was again dissolved in the restored strip solution and the restoration process repeated.

Experiment 1

The electrochemical cell as hereinbefore described was equipped with a TIR-2000 anode, a titanium substrate with an iridium oxide coating, made by Eltech Corp. and a cathode of reduced titanium dioxide ($TiO_x$) in bulk coherent form where x is a number in the region of 1.67 to 1.95 made by Lambertville Ceramic Company. The anolyte was a 0.1 wt % solution of sulfuric acid and the catholyte was one of the metal strip solutions described in the previous paragraph with the following dissolved metals: Solution (1)-cadmium metal; Solution (2) zinc metal; Solution (3)-copper metal; Solution (4) tin; Solution (5) nickel and Solution (6) an equal volume mixture of the five solutions. Each of the metal strip solutions (catholytes) was processed by passing current through the cell at 5 volts until the rate of metal deposition had decreased by about 20%. The cathodes were weighed and immersed in the restored metal strip solution to effect stripping of the plated metal from the cathode. After stripping the metal, the restoration process was repeated. The grams of metal plated on the cathode in the first restoration was: Solution (1) -335; Solution (2) 206; Solution (3) 256; Solution (4) 471; Solution (5) 190; and solution (6) 284. On immersion of the cathode in the restored strip solution, essentially all of the metal was stripped from the cathode. The weight of metal in grams that was plated on the cathode in the second restoration was: Solution (1) 351; Solution (2) 194; Solution (3) 264; Solution (4) 418; Solution (5) 205; and Solution (6) 301. In all processing, the strip solutions returned to the original yellow-orange color after removal of the metal. In similar experiments metal strip solutions made with CLEPO NU-STRI-S, a proprietary formula furnished by Frederick Gumm Chemical Co., Inc. was used to strip metals from steel and restored for ten (10) or more times with similar results.

These experiments show that spent metal strip solutions comprising an alkaline cyanide and an organic acid metal stripping agent such as benzenesulfonic acid-3 nitro and a dissolved metal can be restored and used again.

Experiment 2

To further demonstrate the practice of the instant restoration process, a system was installed for continuously restoring (as used) a metal strip solution comprising 9.4 wt. % alkaline sodium cyanide and 6.5 wt. % or CLEPO NU-STRIP -S, furnished by Frederick Gumm Chemical Company. The metal strip solution was used to strip cadmium metal from steel substrates. The system comprised an electrochemical cell having a cylindrical anolyte compartment containing a TIR-2000 anode, made by Eltech Corporation, that was enclosed (fluids sealed) in a tube of Nafion TM perfluorinated membrane 324, made by Dupont Company. The anolyte compartment had conduits for ingress and egress of fluids to a fluids separator having a means for controlling level of the anolyte by addition of water and a means for egress of gas (oxygen). The anolyte compartment was immersed in the metal strip solution and steel cathodes were spaced around the anolyte compartment. (Alternatively, the stripping solution could be pumped to a restoration tank and back to the metal stripping tank.) The anode was 2.85 inches in diameter and 30 inches long. The membrane was 3.0 inches in diameter and 31 inches long (excluding end seals). The anolyte was a 0.5 wt. % solution of sulfuric acid. The volume of anolyte was one (1) gallon that was used continuously for the 20-day test with only water addition. The volume of the strip solution was about 250 gallons at a temperature of 50 degrees centigrade. Electrical power was supplied by a 0 to 12 volt, 0 to 150 ampere recitifier, made by Rapid Electric Company. The process was operated continuously at 5 volts and 100 amperes with periodic replacement of cathodes. The plated cadmium metal was anodically dissolved from the cathodes into a 10 weight % sodium cyanide and a 1.4 weight % sodium hydroxide solution to form a cadmium cyanide plating solution. Steel parts electroplated with the plating solution were similar to those plated from commercial cadmium cyanide plating liquors. The stripping rate of cadmium from steel substrates was essentially constant for the 20-day test period.

In a continuous process the plating and stripping must be essentially the same. The cell voltage is increased or decreased as necessary to effect removal of the metal at the rate the metals are stripped. The stripping rate remains essentially constant up to some metal content and decreases very rapidly at higher metal levels.

The foregoing example illustrates that the present process can be used to continuously restore the spent metal strip solution and to maintain the concentration of the metal in the strip solution at essentially a constant value. Thus as the metal is removed from the spent strip solution the metal is electroplated from the metal loaded electrodes placed in the anolyte compartment onto steel or other objects to be electroplated.

What is claimed is:

1. A process for electroplating metal from an aqueous solution containing an alkali cyanide, an organic metal stripping agent and a dissolved metal comprising passing electric current through an electrochemical cell having an anolyte compartment containing an anode and an aqueous anolyte that is separated by a membrane from a catholyte compartment containing a cathode and a catholyte of said aqueous solution of an alkali cyanide, an organic metal stripping agent and a dissolved metal whereby said dissolved metal is electroplated from said catholyte in a reducing environment without said catholyte contacting the anode or oxygen formed at the anode and the catholyte with the dissolved metal removed is suitable for stripping metal from a substrate.

2. The process of claim 1 where the alkali cyanide is sodium cyanide.

3. The process of claim 1 where the organic acid metal stripping agent is an organic compound comprising sulfonic, sulfenic, carboxylic or phosphinic acid groups.

4. The process of claim 3 wherein the stripping agent is a compound having as the organic portion an aryl group having a nitro group substituent in the meta position to the acid group.

5. The process of claim 3 where the organic metal stripping agent is benzenesulfonic acid-3 nitro, benzenesulfenic acid-3 nitro or benzene carboxylic acid-3 nitro.

6. The process of claim 1 where the dissolved metal is cadmium, copper, zinc, nickel or tin.

7. In the process of restoring the activity of a metal stripping solution containing excess dissolved metal resulting from use of the solution in stripping of metal coatings from a metal substrate, said solution also containing an alkali metal cyanide and an organic metal stripping agent, the improvement which comprises passing an electric current through an electrochemical cell having an anolyte compartment containing an anode and an aqueous anolyte that is separated by a selective cation permeable membrane from a catholyte compartment containing a cathode and said stripping solution as the catholyte, whereby said dissolved metal is electroplated from said catholyte in a reducing environment without said catholyte contacting said anode or oxygen formed at the anode.

8. The process of claim 7 wherein a series of cathodes are used and as the cathodes become loaded with metal recovered from the stripping solution, the resulting metal loaded cathodes are transferred to an anolyte compartment and connected anodically to dissolve the accumulated metal for use in electroplating.

* * * * *